United States Patent [19]

Poore et al.

[11] Patent Number: 4,782,964

[45] Date of Patent: Nov. 8, 1988

[54] CLOSURE ASSEMBLY FOR A CONTAINER

[75] Inventors: Albert C. Poore, New Malden; Bernard Sams, London, both of England

[73] Assignee: Duma Packaging A/S, Naestved, Denmark

[21] Appl. No.: 110,406

[22] Filed: Oct. 20, 1987

[30] Foreign Application Priority Data

Oct. 21, 1986 [GB] United Kingdom ..... 86-25169

[51] Int. Cl.[4] ..... B65D 55/02

[52] U.S. Cl. ..... 215/216; 215/237; 215/253; 215/211; 222/153

[58] Field of Search ..... 215/206, 209, 216, 235, 215/237, 253, 211; 222/153, 480, 543

[56] References Cited

U.S. PATENT DOCUMENTS

| | | | |
|---|---|---|---|
| 4,209,100 | 6/1980 | Uhlig | 215/237 |
| 4,444,326 | 4/1984 | Musel | 215/209 |
| 4,629,081 | 12/1986 | McLaren | 215/235 |
| 4,687,112 | 8/1987 | Swartzbaugh | 215/216 |
| 4,723,669 | 2/1988 | Barriac | 215/206 |

*Primary Examiner*—George T. Hall

*Attorney, Agent, or Firm*—Cushman, Darby & Cushman

[57] ABSTRACT

The closure assembly comprises a first cap portion hingedly connected to a second cap portion adapted to be positioned over the mouth of an associated container and including an aperture to permit dispensing from the container. The first cap portion is arranged so that in one position it overlies the aperture to close the container, and in another position is lifted clear of the aperture to open the container. The cap portions together include means so that they can be snapped together and their separation from a closed to an open position requires the exertion of a positive force by the user and the first cap portion includes at its periphery opposite its hinged connection with the second cap portion a lip which co-operates with an inwardly displaceable section of the second cap portion. The inwardly displaceable section includes at its upper edge face adjacent the lip a portion which is associated with an outermost lower edge of the lip when the two cap portions are in a closed position and raised above that lower lip edge so that on inward displacement of the said section the raised portion first offers resistance to displacement in its engagement with the lip edge and then, as displacement pressure is increased, forces the lip upwards. In that manner the snap action of the two cap portions can be overcome and the closure opened.

32 Claims, 4 Drawing Sheets

CLOSURE ASSEMBLY FOR A CONTAINER

Figure 1:
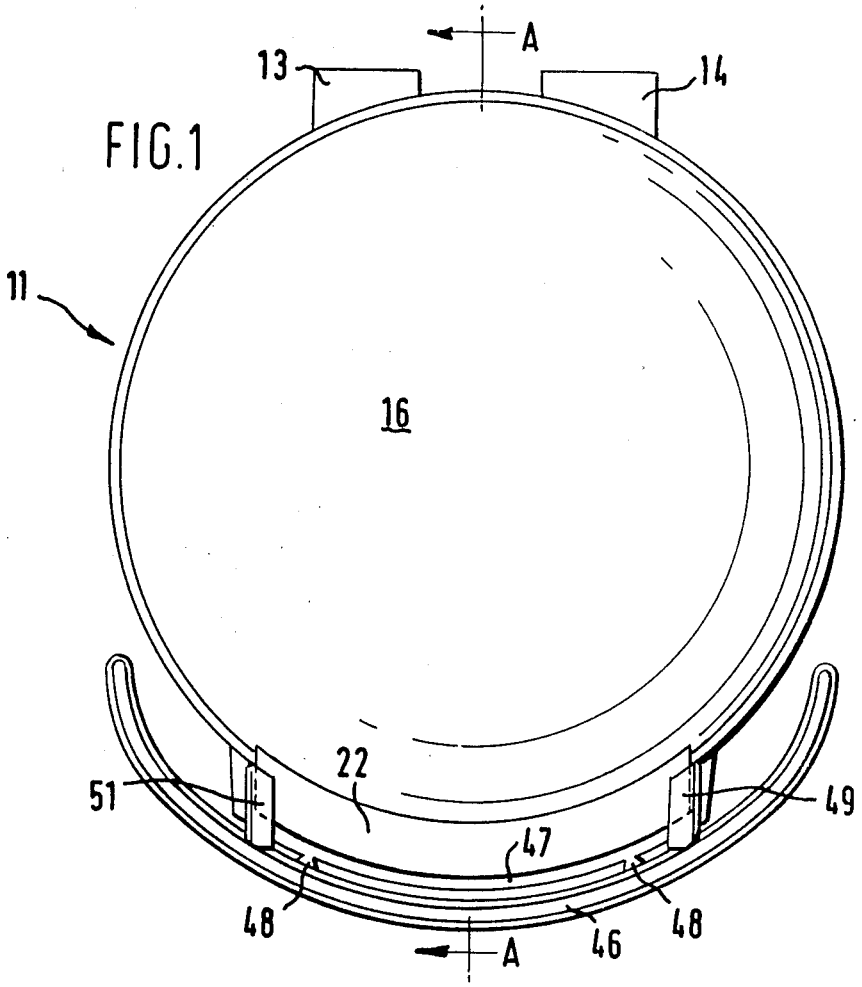

BACKGROUND OF THE INVENTION (a) Field of the Invention

The present invention relates to a closure assembly for a container, in particular to a closure assembly which is child resistant and which is especially adaptable for use with a tamper evident closure arrangement and/or to a closure assembly including a new tamper evident closure arrangement.

(b) Description of the Prior Art

A variety of child resistant closures are known in the art. Such closures rely on features designed to make opening difficult for a child while at the same time (in theory at least) permitting relatively easy access by a more knowledgeable adult. Thus, in one widely used closure arrangement it is necessary to line up two arrows before opening can be effected, and in another widely used arrangement for screw caps the cap must be pressed down while unscrewing, otherwise it rotates freely without opening the closure.

As other examples there may be cited the closures disclosed in British Specifications Nos. 1,442,216 and 2,166,423. In the former there is disclosed a child resistant closure assembly for a container, shaped to give the appearance of a conventional screw cap with longitudinal flutes, serrations, ribs or ridges on its outer surface. The assembly comprises a facsimile cap and a snap on lid adapted both to open and to close an opening in the top of the facsimile cap and to be retained in its closed position to give an integral appearance to the top of the closure assembly. The facsimile cap has a portion of its outer surface which is displaceable inwardly to allow a finger of a user to engage under the snap on lid to overcome the snap action of the lid, the displaceable portion being a portion that is not readily distinguishable from the remainder of the facsimile cap. The child resistant feature of the cap resides in the idea of designing a cap to deceive the uninformed user to attempt to open it in a particular manner i.e. by unscrewing the cap, when in fact the cap is openable in another manner i.e. by flipping open a snap on lid - a fact readily conveyed to the informed (adult) user.

In the latter there is disclosed a two part child resistant closure, which comprises a top cap hingedly connected to an inner cap which is adapted to be semipermanently positioned over the mouth of an associated container. On the inner cap there is a depending skirt and a trigger forming part of the skirt, actuation of the trigger normally being prevented by engagement of the trigger with an arcuate bead on the outside of the associated container whereby the trigger forms a locking means to hold the top cap in its closed position until the closure is angularly displaced relatively to the container into a predetermined position. In that position the trigger on the inner cap can be depressed to disengage the trigger from locking engagement with the top cap.

At present it is well appreciated in the art that child resistant closures can save life. The use of known closures has shown that child safety is considerably improved once a child resistant feature is included in a closure. However, while known, and well tested and approved, child resistant closures have demonstrated the success of the concept, there remains generally a concern that one or both of the degree of child resistance and the ease of use by the elderly could be enhanced.

Thus, for example, with the closure where arrows must be aligned before opening, such alignment can be difficult for the elderly. Also, with the elderly especially, there is a tendency to replace the lid or cap with the arrows aligned for ease of opening next time, but that immediately eliminates the safety feature. Furthermore, the elderly often lack the strength or manual control to press down that closure which requires to be pressed down as it is unscrewed before it will open. Also again, once they have opened such a closure they will often not close it sufficiently to bring the safety feature into operation, thus negating the feature.

Accordingly, there remains in the art a need for a child resistant closure which can be understood by the adult, which is manageable by the elderly, and which when closed (however that may be effected) always includes an operating child resistant feature. That is to say the child resistant feature should operate on closure irrespective of any subsequent twisting or tightening of the lid or cap.

Furthermore, there remains in the art a need for a child resistant closure which can afford an acceptable level of child resistance while at the same time being adaptable for use with a tamper evident closure arrangement.

OBJECTS OF THE INVENTION

A principal object of this invention is to provide a child resistant closure which can be understood by the adult, which is manageable by the elderly, and which when closed always includes an operating child resistant feature.

Another object of the invention is to provide a closure with a child resistant feature which operates on closure irrespective of any subsequent action by the user such as by twisting or tightening.

A further object of the invention is to provide a child resistant closure which can afford an acceptable level of child resistance while at the same time being adaptable for use with a tamper evident closure arrangement.

Yet another object of the invention is to provide a closure assembly not requiring in operation an initial angular displacement of a cap portion.

A still further object of the invention is to provide a closure including a means of lifting the lid which does not require initial engagement by a user's finger with a liftable lid portion.

In addition, another object of the invention is to provide a closure assembly with a novel tamper-evident closure arrangement which may be employed, if desired, independently of a child resistant feature.

In accordance with the foregoing objects, this invention provides a closure assembly for a container, the closure assembly comprising a first cap portion hingedly connected to a second cap portion, the second cap portion being adapted to be positioned over the mouth of an associated container and including an aperture to permit dispensing from the container, the first cap portion being arranged whereby in one position it overlies the aperture to close the container, and in another position is lifted clear of the aperture to open the container, the cap portions together including means or being arranged such that they can be snapped together and their separation from a closed to an open position requires the exertion of a positive force by the user, the first cap portion including at its periphery opposite its hinged connection with the second cap portion a lip which co-operates with an inwardly displaceable section of the second cap portion, the inwardly displaceable section including at its upper edge face adjacent the lip a portion which is associated with an outermost lower edge of the lip when the two cap portions are in a closed position and raised above that lower lip edge in a manner such that on inward displacement of the said section the raised portion first offers resistance to displacement in its engagement with the lip edge and then, as displacement pressure is increased, forces the lip upwards at least to begin to overcome the snap action of the two cap portions and positively to open the closure.

DESCRIPTION OF THE PREFERRED ARRANGEMENTS

Figure 2:
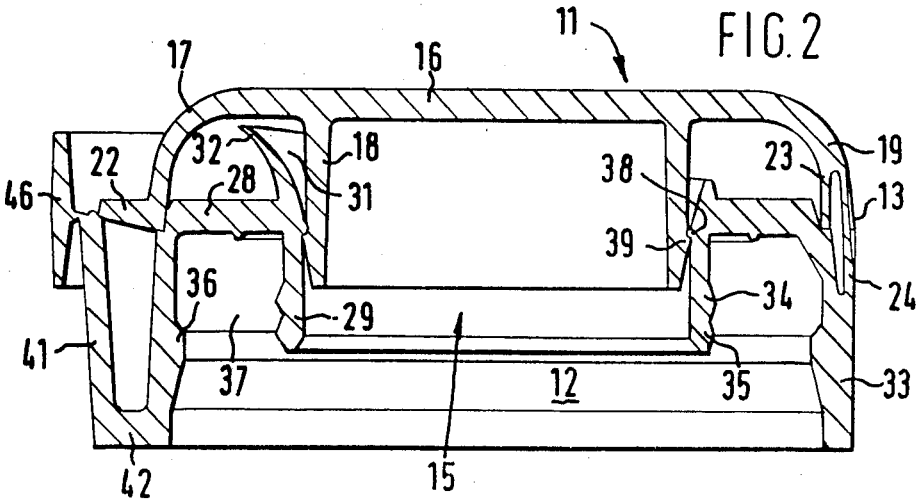
Figure 3A:
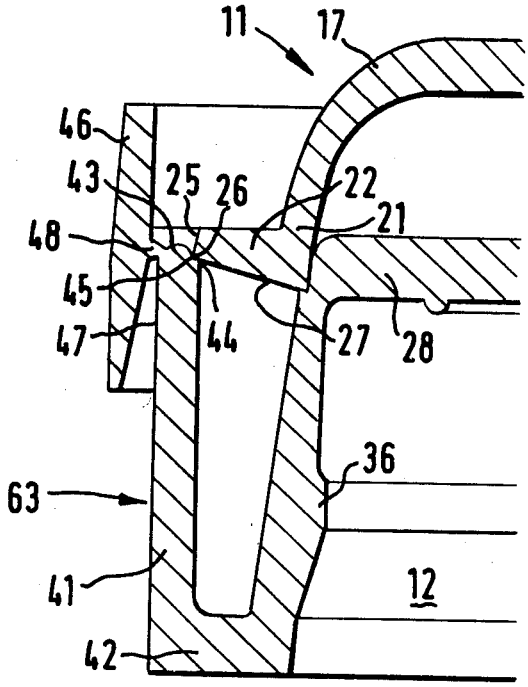
Figure 3B:
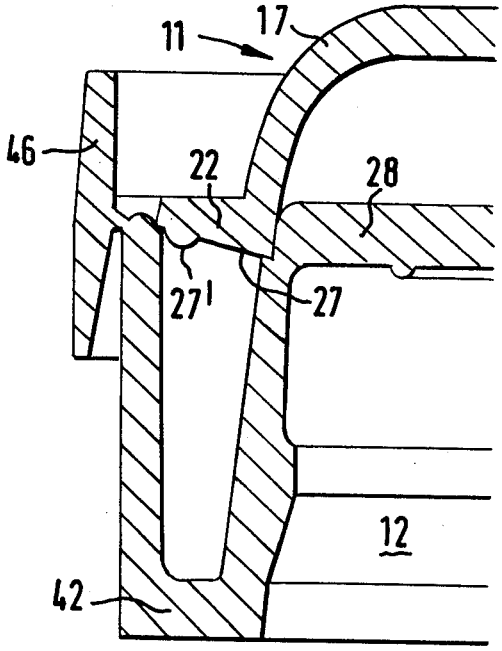
Figure 4A:
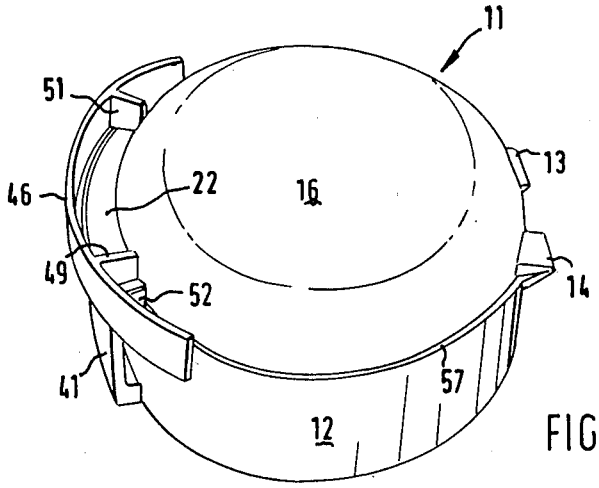
Figure 4B:
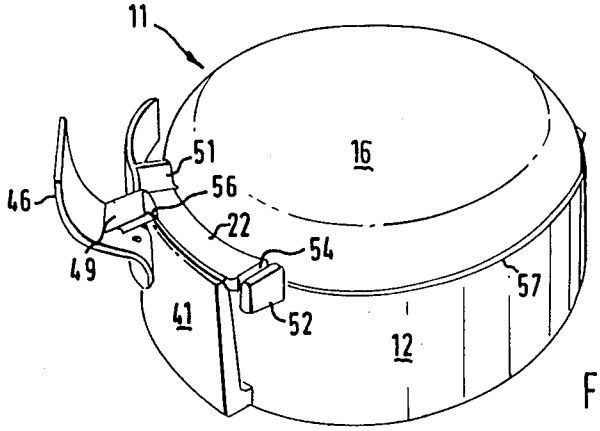
Figure 4C:
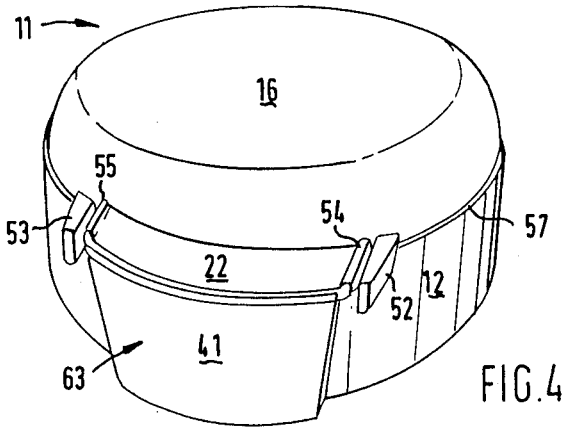
Figure 5:
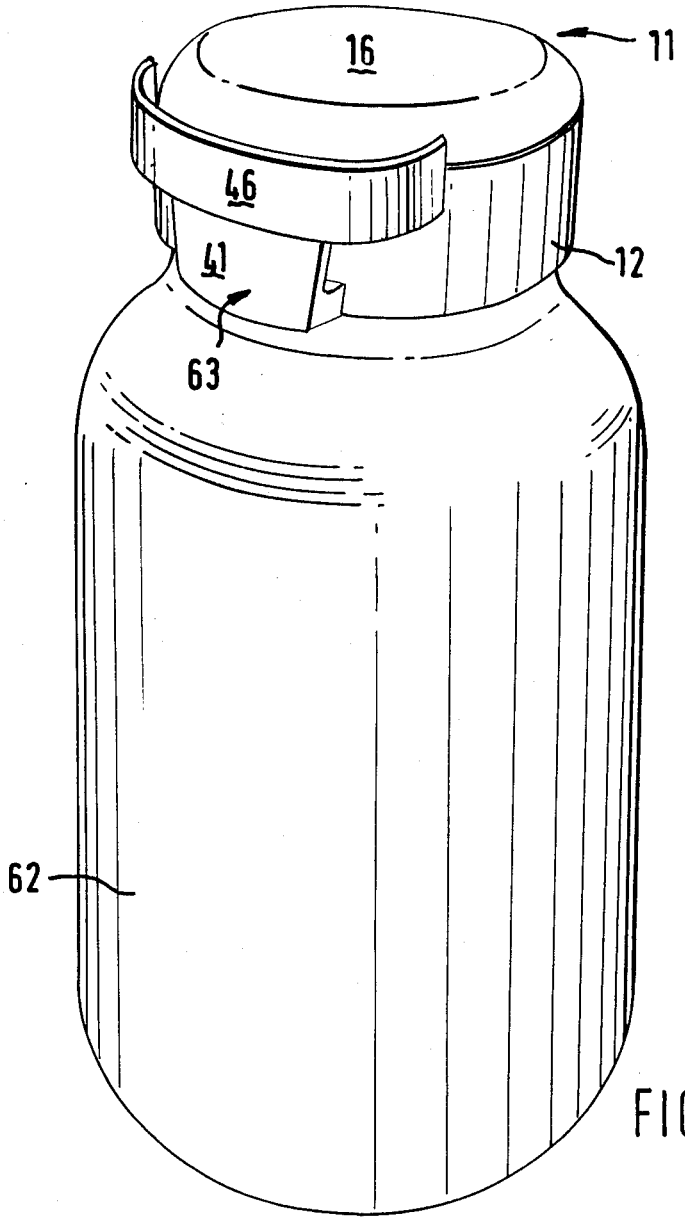

In order that the invention may be better understood, it will now be described in greater detail, with various preferred arrangements being given. Also, specific closure assemblies of the invention and their uses will be described by way of example only with reference to the accompanying drawings as necessary. In the drawings:

FIG. 1 shows one form of closure assembly in accordance with the invention viewed from above, FIG. 2 shows a cross-section along line A—A of the assembly of FIG. 1, FIG. 3 (*a*) shows an enlarged detail to the lefthand side of the cross-section of FIG. 2, FIG. 3 (*b*) shows a variant on the detail of FIG. 3(*a*), FIGS. 4(*a*) to 4(*c*) show various perspective views of the closure assembly as shown in FIGS. 1 to 3 to illustrate the removal of the tamper evident arrangement, and FIG. 5 shows a perspective view of the assembly of FIGS. 1 to 4 disposed on a glass bottle.

As will be appreciated from the above general definition, and as will be appreciated from the description below, the closure assembly of the invention has the advantage over closures such as that described in Specification No. 2,166,423 of not requiring any initial angular displacement of a cap portion. At the same time, because of the inclusion of a raised portion on the inwardly displaceable section, it has the advantage over the closure of Specification No. 1,442,216 of providing a means of lifting the lid which does not require initial engagement by a user's finger with a lid portion. Thus, the closure assembly is operable either by simple application of finger pressure to said section or by pressing said section on a surface or with a simple tool, without the need to apply a lid lifting action. Of course, as will be understood by those familiar with the use of closures it may be that in practice the finger movement to create finger pressure inwards to overcome the snap action i.e. to "pop up" the second cap portion, may be combined in a continuous movement also to "flick up" the second cap portion once the snap action is begun to be overcome. In other words there may be to all intents and purposes one movement to open the closure combining "pop up" and "flick up" actions.

Furthermore, it will be appreciated that in the open position the closure assembly permits dispensing from the container. That is to say the second cap is so disposed in relation to the first cap portion and the aperture is so shaped and/or sized to permit the consumer to avail himself of the product contained within the container. Thus, the dispensing permitted may be of a liquid or suspension, for example, as drops, or of a solid such as tablets, capsules or a powder.

While in theory the closure assembly of the invention may be made in more than one piece, in practice (if only for economic reasons) generally it will be made as a one piece closure. Thus, the closure generally will be formed (usually by moulding) in a manner whereby the two cap portions are joined together at their hinge connections during the forming operation.

In the closure assembly of the invention the two cap portions are preferably connected by a flexible hinge connection which can hold the second closure portion in an open position, particularly when the container is inverted . Thus, preferably the hinge connection is a toggle-action hinge, and more preferably, the two cap portions are connected by a toggle-action hinge which permits the first cap portion initially to be raised to a first (usually only just) open position and then to be raised to a second (usually wide) open position. That is to say the hinge preferably may be one which permits the first cap portion to be flipped up open in two stages.

The closure assembly of this invention may be formed of any suitable material, but preferably is formed from a plastics material, most preferably polypropylene. However, while polypropylene is the most preferred plastics material, other materials of similar properties may be employed if desired, for example, low, medium or high density polyethylene, nylon or a polypropylene copolymer.

A closure assembly according to the invention is one which is especially adaptable for use with a tamper evident closure arrangement. Preferably, therefore, the closure assembly includes means associating the first cap portion with the second cap portion whereby any separation of the portions from a closed position to an open position is made evident by the need first to remove said tamper evident means. More preferably, the tamper evident means comprises a strip removably joined to the second cap portion and which includes one or more (and preferably two) portions, such as flanges, overlying the first cap portion (preferably the lip thereof) to retain the first cap portion in a closed position. In such an arrangement, the said strip portions preferably overlie opposite edges of the lip.

Still more preferably, in the closure assembly of the invention the said tamper evident means comprises a strip removably joined to the second cap portion which includes flange portions overlying the lip of the first portion to retain the first cap portion in a closed position, the said flange portions extending from the strip and overlying the two side ends of the lip to prevent upward movement of the first cap portion, and the strip being joined to the second cap portion at least via the two overlying flange portions which are each formed integral with a mounting pillar extending from the periphery of the second cap portion to either side of the lip.

By providing a tamper evident strip which is joined to the second cap portion at least via the two overlying flange portions which are each formed integral with a mounting pillar, the strip can be so formed that it is removable through lines of weakness across the areas where the flanges and pillars are joined whereby the pillars remain extending from the periphery of the second cap on removal of the tamper evident strip to protect the side edges of the lip. In that manner the child resistance of the closure is enhanced.

Alternatively, of course, where such enhancement of child resistance is not required - for example, in the other aspect mentioned below - the lines of weakness may be formed elsewhere than across the areas where the flanges and pillars are joined. Thus, in one preferred alternative the lines of weakness may be between the pillars and the second cap portion so that the pillars are removed with the strip.

With such a tamper evident arrangement the two side ends of the lip and the overlying flanges preferably are configured so that they interlock as soon as any lifting movement is imparted to the first cap portion during any tampering. Thus, for example, the lip may include on its upper face at its two side ends upwardly extending beads which interengage with a respective recess beneath each flange to provide said interlocking. Furthermore, in any of the above arrangements the tamper evident strip also may be removably joined to the inwardly displaceable section.

The above more preferred tamper evident means besides being especially useful within the context of the closure assembly of the first aspect of the invention is in itself new and applicable to other closure assemblies which do not include the same childresistant features. Accordingly, in another aspect the invention provides a closure assembly for a container, the closure assembly comprising a first cap portion hingedly connected to a second cap portion, the second cap portion being adapted to be positioned over the mouth of an associated container and including an aperture to permit dispensing from the container, the first cap portion being arranged whereby in one position it overlies the aperture to close the container, and in another position is lifted clear of the aperture to open the container, the cap portions together including means or being arranged such that they can be snapped together and their separation from a closed to an open position requires the exertion of a positive force by the user, the first cap portion including at its periphery opposite its hinged connection with the second cap portion a lip which permits the first cap portion to be forced upwards to overcome the snap action of the two cap portions and positively to open the closure, the assembly including means associating the first cap portion with the second cap portion whereby any separation of the portions from a closed position to an open position is made evident by the need first to remove said means, the said tamper evident means comprising a strip removably joined to the second cap portion which includes flange portions overlying the lip of the first cap portion to retain the first cap portion in a closed position, the said flange portions extending from the strip and overlying the two side ends of the lip to prevent upward movement of the first cap portion, and the strip being joined to the second cap portion at least via the two overlying flange portions which are each formed integral with a mounting pillar extending from the periphery of the second cap portion to either side of the lip.

Of course, as will be appreciated from the description herein the closure assembly of the second aspect may include such one or more features of the closure assembly of the first aspect as may be applicable to it. Also, as will be appreciated by those skilled in the art of designing closure assemblies, the detailed design of each cap portion in each aspect as defined above may vary to a considerable degree depending on the intended use of the assembly. Thus, for example, the first cap portion may be of a simple lid design adapted merely to close the aperture of the second cap portion by overlying the aperture. Preferably, however, the cap portions are of a more complex design whereby the first cap portion can be fitted within and or around the second cap portion and the second cap portion can be fitted within and/or around the mouth of a container such as a glass or plastics bottle or jar or the like.

In particular, it is preferred that the first cap portion includes one or more annular skirt portions engageable with the aperture in the second cap portion and/or with at least a part of the outer periphery of the second cap portion. Where such an arrangement is employed the first cap portion may include an outer annular and peripheral skirt which fits around and over a recessed upper peripheral edge of the second cap portion. Furthermore, the recessed upper peripheral edge of the second cap portion preferably slopes downwardly away from the outside of the assembly and the lower edge of the peripheral skirt portion of the first cap portion is configured to mate with that edge, thus providing a further safety feature in terms of entry resistance. In addition, the lip of the first cap portion may extend from said outer peripheral skirt portion, preferably at or adjacent a lower edge thereof.

Also, the second cap portion preferably comprises an outer annular and peripheral skirt portion and an inner annular skirt portion defining between them an annular space adapted to accommodate fitted therein the upper wall defining the mouth of a container. In such an arrangement the outer skirt portion is preferably deeper than the inner skirt portion, and the two skirt portions may depend from an upper wall which can either extend inwardly of the inner skirt portion and include the aperture of the second cap portion, or extend only up to the inner skirt portion whereby that inner skirt portion defines the said aperture. Of course, in the former case the aperture may be of any convenient size relative to the size of the inner skirt portion annulus and either concentric or eccentric with respect to the annulus. Preferably, however, in the former case, the aperture is eccentric with respect to the annulus and disposed at or adjacent that part thereof nearest the said inwardly displaceable section.

Furthermore, in any or all of the above arrangements the various interfitting portions or parts may include such ribs, slots or the like as may be necessary or desired to ensure that they can be fitted together in a secure arrangement. In particular, the closure assembly must be securable on an associated container, although such securing may be achieved in a number of ways. For example, the closure assembly may be one which can be snapped onto a container or secured on a container by a non-returnable screw thread. In addition, the cap portions must be such that they can be snapped together.

Whatever the detailed design of the second cap portion it includes in said one aspect an inwardly displaceable section which co-operates with the lip of the first cap portion. That section may be a section of the outer surface of the second cap portion either formed as an integral part of that surface or disposed on or over or in association with that surface. The only requirement is that the section should be inwardly displaceable and accessible to be so displaced.

Preferably, however, the inwardly displaceable section is formed externally of any part or parts of the second cap portion adapted to be disposed associated with a container mouth. In particular, the inwardly displaceable section is preferably one which is external of any outer annular skirt portion. Thus, for example, the inwardly displaceable section may be an inwardly displaceable flexible section formed externally of and over part of such an outer skirt portion, and may include flexible side walls integral therewith. More preferably, however, the inwardly displaceable section is connected to the remainder of the second cap portion only at its lower periphery, thereby effectively pivoting about a hinge between the cap portion and the section. Furthermore, in one preferred design the inwardly displaceable section tapers from its upper to its lower edge thereby to afford more purchase to the finger in the opening operation.

In the closure assembly of the invention, the effectiveness of the child resistant feature depends on the association between the raised portion at the upper edge face of the inwardly displaceable section and the outermost edge of the lip. That association is such that on inward displacement of the said section the raised portion first offers resistance to displacement in its engagement with that lip edge and then, as displacement pressure is increased, forces the lip upwards to overcome the snap action of the two cap portions. Therefore, as will readily be appreciated by those skilled in the art, the association can be designed such that the degree of initial resistance is sufficiently high to deter a curious child but not so high as to make opening of the closure assembly too difficult for an adult. Furthermore, the child resistance level of the closure can be enhanced by ensuring that the two cap portions snap fit together in a manner which does not permit easy opening by insertion of a finger nail or the like between the two portions, for example, by employing the sloping recessed upper peripheral edge feature for the second cap portion as mentioned above. In that manner opening should be achievable generally only by an adult via the inwardly displaceable section.

As to the degree of initial resistance, that will depend on the shape or configuration and size of the raised portion, the degree to which it is raised above the lower edge of the lip, and on the shape or configuration of the lip edge face. Preferably, the lip edge face is shaped so as to present a sharp lower edge to the raised portion of the displaceable section, and preferably may slope back from that raised portion either as a planar or as a curved face. Preferably also, the raised portion is set back from the edge of the upper edge face of the inwardly displaceable section. In that manner a strip along the edge face can sit under the lip of the first cap portion and the lip edge can rest on the thus-formed step disposed away from the base of the raised portion. In addition, it is preferred that the raised portion should have a smoothly curved surface profile upwards and away from said step, and also that the raised portion should run along essentially the whole of the upper edge face of the inwardly displaceable section.

Furthermore, it is preferred that the lip has a lower face which slopes downwardly away from the raised portion of the inwardly displaceable section. In that manner, the initial opening impetus given to the first cap portion can be enhanced to overcome the snap action. Such enhancement is obtained provided the lower face is at least planar and is not concave. However, the enhancement can also be made more pronounced by including a convex surface portion e.g. a "bump", in the lower face, which preferably extends across at least a major portion of the face.

In addition, the degree of resistance to opening can be varied by increasing or decreasing the ease with which the displaceable section as such can be displaced inwardly. Thus, for example, the preferred connection of the inwardly displaceable section to the remainder of the second cap portion only at its lower periphery may be arranged so that a linear hinge is formed (as illustrated below) or alternatively the connection may be through a curve hinge portion with the two ends of the hinge curving upwards away from the said periphery, thus varying the resistance of the section to displacement and consequently the pressure necessary to displace the section. As a further alternative, walls may be formed extending upwardly from the lower periphery part way along the displaceable section either at the two sides of the section or just inwardly of those two sides, again to vary the resistance of the section to displacement and consequently the pressure necessary to displace the section.

As will be appreciated from the above description, the invention also provides a container including a closure assembly according to the invention, the container typically being a glass or plastics bottle or jar. Furthermore, the invention includes a container having a closure assembly according to the invention either formed separately of the container or as one piece therewith. Thus, the latter embodiment would provide a closure assembly of the invention together with a container as an integral unit.

Referring now to the drawings, in particular FIGS. 1 and 2 in the first instance, the assembly, shown comprises a first cap portion 11 connected to a second cap portion 12 via hinge elements 13 and 14. In the closed position shown the first cap portion 11 overlies the second cap portion 12 and closes an aperture 15 which in the open position permits dispensing from an associated container.

The first cap portion 11 comprises a lid section having an outer annular and peripheral skirt 17 depending therefrom, and an inner annular skirt 18 also depending therefrom. At its rear edge 19 the skirt 17 includes hinge elements 13 and 14, and at its front lower edge 21 a lip 22. Also at its rear edge 19 the skirt 18 in that part thereof disposed between the hinges 13 and 14 is split into an inner part 23 and an outer part 24 which is joined to the second cap portion 12. In that manner the outer part 24 can be formed integrally with cap portion 12 such that it can provide a toggle action to bias the portions 11 and 12 about the hinge elements 13 and 14 to urge those portions from a first (just) open position (not shown) to a second (wide) open position (also not shown), and to hold them in that second open position.

As can be seen more specifically from FIG. 3(*a*), the lip 22 of the first cap portion 11 extends outwardly from the front lower edge 21 of the skirt 17. The lip includes a front edge face 25 which slopes slightly towards the skirt 17 and thus provides a relatively sharp lower edge 26. Also, the lower face 27 of the lip slopes downwardly towards the skirt 17 and may include, as shown in FIG. 3(*b*), a convex "bump" 27'.

As shown in FIG. 2, the second cap portion 12 comprises an upper wall 28 which is an annulus defining at its inner edge aperture 15. More specifically, aperture 15 is defined by an inner skirt 29 depending from wall 28 at that inner edge thereof, and an upstanding wall 31 surrounding the aperture 15 which in turn is formed to provide a pouring spout 32. In addition, the wall 28 has depending from its outer periphery an outer skirt 33.

On the face of skirt 29 nearest skirt 33 there are ribs 34 and 35. Also, on the face of skirt 33 nearest skirt 29 there is a rib 36. As shown the ribs 34 to 36 and annular space 37 defined between the skirts 29 and 33 are shaped or configured such that the closure assembly can be disposed mounted on a container at its mouth in a secure manner. Thus, in the arrangement shown the closure assembly can effectively be snapped onto a container at its mouth to provide the closure therefor.

Furthermore, on the face of skirt 29 nearest the aperture 15 and at about the level of wall 28 there is a rib 38 which is engageable with a rib 39 on the outer face of inner skirt 18 of the first cap portion 11. The ribs 38 and 39 are engaged together in the closed position shown to provide the overall snap closure action of the assembly. The sizes of ribs 38 and 39 and the form of their interrelationship are chosen so that the desired or required snap action is provided. Also, at its rear the skirt 33 includes a split part corresponding to the inner part 23 and outer part 24 of the first cap portion 11.

In addition, as can be seen from FIGS. 3(*a*) and 3(*b*) especially, at its lower front edge the skirt 33 carries a section 41 connected by a hinge strip 42 to that edge. The section 41 extends upwardly to the lip 22 and carries on its upper edge face a raised rib 43 disposed outwardly of the inner upper edge 44 so as to form a step 45 on which the lip 22 rests. Also, the section 41 carries a tamper-evident strip 46 attached to its outer upper edge 47 by frangible ribs 48.

As can be seen in more detail with reference to FIGS. 4(*a*) to 4(*c*), the tamper-evident strip 46 includes flanges 49 and 51 disposed above the lip 22 at opposite side ends thereof so that the flanges overlie the lip and prevent upward movement until the strip 46 is removed. The flanges 49 and 51 are themselves integral with pillars 52 and 53 extending from the periphery of the second cap portion 12. In addition, the two side ends of the lip 22 include beads 54 and 55 which interengage with respective recesses 56 (only one shown in FIG. 4(*b*)) beneath each flange 49 and 51 so that the two side ends of the lip 22 and the overlying flanges interlock as soon as any (unwanted) movement is imparted to the first cap portion, that is during potential tampering.

Also, the strip 46 is so formed that it is removable through lines of weakness across areas where the flanges 49 and 51 and the pillars 52 and 53 are joined to permit the pillars to remain as shown in FIG. 4(*c*) on removal of the strip 46. In that manner, as can be seen from FIG. 4(*c*), the side edges of the lip 22 are protected from unwanted interferance. Furthermore, the second cap portion 12 provides in the closed position shown in FIGS. 4(*a*) to 4(*c*) a recessed upper peripheral edge 57, which can slope downwardly (not shown) from the outside of the assembly and the lower edge of the peripheral skirt portion of the first cap portion may be configured (not shown) to mate with that edge.

In use, the closure assembly is disposed on a container 62, for example, as shown in FIG. 5. The container and closure together are thus suitable for original pack dispensing in a tamper-evident arrangement which readily reveals any tampering with the product dispensed in the container. However, subsequent to dispensing the strip 46 can be torn away in the sequence as shown in FIGS. 4(*a*) to 4(*c*), thus rendering the container suitable for use in providing access to the product therein. For example, with the aperture arrangement shown the product typically may be a liquid product which can be poured out via spout 32.

When opening the container the user applies pressure to outer face 63 of section 41 (usually in the upper part thereof). That pressure causes the raised rib 43 to engage lower edge 26 of the lip 22, which in turn causes a resistance to further inward displacement of section 41. Such resistance is a deterrent to casual users such as children, but may be overcome by applying greater pressure to face 63, either with the finger or by pressing on a surface or with a tool, whereby rib 43 is forced under lip 22 and slides beneath the lip and down face 27 to overcome the snap action between the closure portions 11 and 12 provided by ribs 38 and 39. In that manner, the portion 11 can be forced open to a first (just) open position, after which it can be raised to a second (wide) open position determined by the toggle spring action of part 24.

In the second (wide) open position of the closure, and with the portion 11 held in that position, product can be poured out of the container via spout 32. Then portion 11 can be returned to the snapped closed position as shown with ribs 38 and 39 interengaged to secure the container after use.

As will be appreciated from the above description, in one aspect, the invention provides a child resistant closure assembly, which is especially adaptable for use with a tamper-evident closure arrangement. Furthermore, the degree of child resistance can be adjusted as desired or required by altering the shape or configuration of the arrangement as between the raised rib portion 43 and the lip 22. Also, as will be appreciated, in accordance with a second aspect of the invention there is provided a closure assembly with a tamper-evident closure arrangement which may be employed, if desired, independently of the child resistant feature.

In addition, it will be appreciated that the invention is not limited to the details specifically described above. Thus, numerous variations and modifications may be made to the described structures to obtain a variety of closure assemblies within the scope of the invention as defined by the claims which follow.

We claim:

1. A closure assembly for a container, the closure assembly comprising a first cap portion hingedly connected to a second cap portion, the second cap portion being adapted to be positioned over the mouth of an associated container and including an aperture to permit dispensing from the container, the first cap portion being arranged whereby in one position it overlies the aperture to close the container, and in another position is lifted clear of the aperture to open the container, the cap portions together including means or being arranged such that they can be snapped together and their separation from a closed to an open position requires the exertion of a positive force by the user, the first cap portion including at its periphery opposite its hinged connection with the second cap portion a lip which co-operates with an inwardly displaceable section of the second cap portion, the inwardly displaceable section including at its upper edge face adjacent the lip a portion which is associated with an outermost lower edge of the lip when the two cap portions are in a closed position and raised above that lower lip edge in a manner such that on inward displacement of the said section the raised portion first offers resistance to displacement in its engagement with the lip edge and then, as displacement pressure is increased, forces the lip upwards at least to begin to overcome the snap action of the two cap portions and positively to open the closure.

2. A closure assembly according to claim 1, wherein the two cap portions are connected by a flexible hinge connection which can hold the second closure portion in an open position.

3. A closure assembly according to claim 1, wherein the two cap portions are connected by a toggle-action hinge.

4. A closure assembly according to claim 1, which includes means associating the first cap portion with the second cap portion whereby any separation of the portions from a closed position to an open position is made evident by the need first to remove said means.

5. A closure assembly according to claim 1, which includes the tamper evident means comprises a strip removably joined to the second cap portion and which includes one or more flange portions overlying the lip of the first cap portion to retain the first cap portion in a closed position.

6. A closure assembly according to claim 5, wherein the said strip portions overlie opposite edges of the lip.

7. A closure assembly according to claim 4, wherein the tamper evident means comprises a strip removably joined to the second cap portion which includes flange portions overlying the lip of the first cap portion to retain the first cap portion in a closed position, the said flange portions extending from the strip and overlying the two side ends of the lip to prevent upward movement of the first cap portion, and the strip being joined to the second cap portion at least via the two overlying flange portions which are each formed integral with a mounting pillar extending from the periphery of the second cap portion to either side of the lip.

8. A closure assembly according to claim 7, wherein the strip is so formed that it is removable through lines of weakness across the areas where the flanges and pillars are joined whereby the pillars remain extending from the periphery of the second cap portion on removal of the tamper evident strip to protect the side edges of the lip.

9. A closure assembly according to claim 7, wherein the two side ends of the lip and the overlying flanges are configured so that they interlock as soon as any lifting movement is imparted to the first cap portion.

10. A closure assembly according to claim 9, wherein the lip includes on its upper face at its two side ends upwardly extending beads which interengage with a respective recess beneath each flange to provide said interlocking.

11. A closure assembly according to claim 5, wherein the tamper evident strip is removably joined to the inwardly displaceable section.

12. A closure assembly according to claim 1, wherein the first cap portion includes one or more annular skirt portions engageable with the aperture in the second cap portion and/or with at least a part of the outer periphery of the second cap portion.

13. A closure assembly according to claim 12, wherein the first cap portion includes an outer annular and peripheral skirt portion which fits around and over a recessed upper peripheral edge of the second cap portion.

14. A closure assembly according to claim 13, wherein the recessed upper peripheral edge of the second cap portion slopes downwardly away from the outside of the assembly and the lower edge of the peripheral skirt portion of the first cap portion is configured to mate with that edge.

15. A closure assembly according to claim 12, wherein the lip of the first cap portion extends from an outer peripheral skirt portion at or adjacent a lower edge thereof.

16. A closure assembly according to claim 1, wherein the second cap portion comprises an outer annular and peripheral skirt portion and an inner annular skirt portion defining between them an annular space adapted to accommodate fitted therein the upper wall defining the mouth of a container.

17. A closure assembly according to claim 16, wherein the two skirt portions of the second cap portion depend from an upper wall which either extends inwardly of the inner skirt portion and includes the aperture of the second cap portion or extends only up to the inner skirt portion whereby that inner skirt portion defines the said aperture.

18. A closure assembly according to claim 1, wherein the inwardly displaceable section is formed externally of any part or parts of the second cap portion adapted to be disposed associated with a container mouth.

19. A closure assembly according to claim 18, wherein the inwardly displaceable section is an inwardly displaceable flexible section formed externally of and over part of an outer skirt portion of the second cap portion.

20. A closure assembly according to claim 18, wherein the inwardly displaceable section is connected to the remainder of the second cap portion only at its lower periphery.

21. A closure assembly according to claim 1, wherein the inwardly displaceable section tapers from its upper to its lower edge.

22. A closure assembly according to claim 1, wherein the edge face of the lip is shaped so as to present a sharp edge to the raised portion of the inwardly displaceable section, and slopes back from that raised portion either as a planar or as a curved face.

23. A closure assembly according to claim 1, wherein the raised portion is set back from the edge of the upper edge face of the inwardly displaceable section.

24. A closure assembly according to claim 1, wherein the raised portion of the inwardly displaceable section of the second cap portion has a smoothly curved surface profile.

25. A closure assembly according to claim 1, wherein the raised portion of the inwardly displaceable section of the second cap portion runs along essentially the whole of the upper edge face.

26. A closure assembly according to claim 1, wherein the lip of the first cap portion has a lower face which slopes downwardly away from the raised portion of the inwardly displaceable section.

27. A container including a closure assembly according to claim 1.

28. A closure assembly for a container, the closure assembly comprising a first cap portion hingedly connected to a second cap portion, the second cap portion being adapted to be positioned over the mouth of an associated container and including an aperture to permit dispensing from the container, the first cap portion being arranged whereby in one position it overlies the aperture to close the container, and in another position is lifted clear of the aperture to open the container, the cap portions together including means or being arranged such that they can be snapped together and their separation from a closed to an open position requires the exertion of a positive force by the user, the first cap portion including at its periphery opposite its hinged connection with the second cap portion a lip which permits the first cap portion to be forced upwards to overcome the snap action of the two cap portions and positively to open the closure, the assembly including means associating the first cap portion with the second cap portion whereby any separation of the portions from a closed position to an open position is made evident by the need first to remove said means, the said tamper evident means comprising a strip removably joined to the second cap portion which includes flange portions overlying the lip of the first cap portion to retain the first cap portion in a closed position, the said flange portions extending from the strip and overlying the two side ends of the lip to prevent upward movement of the first cap portion, and the strip being joined to the second cap portion at least via the two overlying flange portions which are each formed integral with a mounting pillar extending from the periphery of the second cap portion to either side of the lip.

29. A closure assembly according to claim 28, wherein the lip of the first cap portion co-operates with an inwardly displaceable section of the second cap portion, the inwardly displaceable section including at its upper edge face adjacent the lip a portion which is associated with an outermost lower edge of the lip when the two cap portions are in a closed position and raised above that lower lip edge in a manner such that on inward displacement of the said section the raised portion first offers resistance to displacement in its engagement with the lip edge and then, as displacement pressure is increased, forces the lip upwards at least to begin to overcome the snap action of the two cap portions and positively to open the closure.

30. A closure assembly according to claim 28, wherein the strip is so formed that it is removable through lines of weakness across the areas where the flanges and pillars are joined whereby the pillars remain extending from the periphery of the second cap portion on removal of the tamper evident strip to protect the side edges of the lip.

31. A closure assembly according to claim 28, wherein the two side ends of the lip and the overlying flanges are configured so that they interlock as soon as any lifting movement is imparted to the first cap portion.

32. A container including a closure assembly according to claim 28.

* * * * *